US005864078A

United States Patent [19]

Koevering

[11] Patent Number: 5,864,078

[45] Date of Patent: Jan. 26, 1999

[54] ELECTRONIC PIANO HAVING AN INTEGRATED MUSIC STAND AND TOUCH SCREEN INTERFACED DISPLAY

[75] Inventor: David Van Koevering, Hermitage, Tenn.

[73] Assignee: Van Koevering Company, Des Moines, Iowa

[21] Appl. No.: 781,309

[22] Filed: Jan. 15, 1997

Related U.S. Application Data

[60] Provisional application Nos. 60/020,601 Jun. 24, 1996 and 60/021,522 Jul 11, 1996.

[51] Int. Cl.[6] ..... G10C 1/00; G10C 3/00

[52] U.S. Cl. ..... 84/478; 84/477 R; 84/719; 84/DIG. 6

[58] Field of Search ..... 84/615, 626, 658, 84/687–690, DIG. 6, DIG. 7, 478, 477 R, 718, 719

[56] References Cited

U.S. PATENT DOCUMENTS

| | | | |
|---|---|---|---|
| 4,366,741 | 1/1983 | Titus | 84/478 |
| 4,939,969 | 7/1990 | Taguchi et al. | 84/719 |
| 5,153,829 | 10/1992 | Furuya et al. | 364/419 |

*Primary Examiner*—William M. Shoop, Jr.
*Assistant Examiner*—Marlon T. Fletcher
*Attorney, Agent, or Firm*—Quarles & Brady

[57] ABSTRACT

An electronic piano includes an electronic keyboard; a graphical user interface, having a video display and a touch responsive overlay, for displaying graphical images representing controllable parameters of the electronic piano and generating control signals; a control system for the electronic piano and the graphical user interface; a piano housing supporting the electronic keyboard and providing a desk surface above the keyboard; and a music stand mounted to the desk surface for supporting sheet material, wherein the graphical user interface forms part of the music stand. The graphical user interface can be mounted in an opening in the music stand and can provide a touch screen flush with the music support surface or recessed.

7 Claims, 3 Drawing Sheets

ELECTRONIC PIANO HAVING AN INTEGRATED MUSIC STAND AND TOUCH SCREEN INTERFACED DISPLAY

CROSS-REFERENCE TO RELATED APPLICATIONS

This application claims the benefit of United States Provisional Application No. 60/020,601, filed Jun. 24, 1996, and United States Provisional Application No. 60/021,522, filed Jul. 11, 1996.

1. Field of the Invention

The invention relates to electronic pianos and more particularly to electronic pianos with user controlled computers.

2. Background of the Invention

A variety of electronic musical instruments, particularly electronic keyboards, have been integrated in the past with microprocessor based computer systems to provide additional features and advantages. These computer based musical instruments have often used some type of electronic display, typically either CRT or LCD, to present graphical information generated by the computer to the user. The information has included such things as status and function configuration information for the electronic instrument or educational information, such as musical scores to assist the user in playing or otherwise using the associated musical instrument.

While significant advances have been made in bringing the advantages of computer technology to the musical instrument environment, the arrangement of the computer display and associated inputs have not been integrated into a traditional piano housing to maintain the aesthetic values of the instrument. Further, the arrangement of input controls have not been ergonomically positioned for convenient use, particularly during actual performance on the instrument while maintaining traditional aesthetics.

SUMMARY OF THE INVENTION

It is therefore an object of the invention to provide a computer display and associated user input that integrates into a traditional piano environment, be it grand, console or ensemble, so as to maintain the aesthetic appearance of the piano.

It is another object of the invention to provide a display and user input that is ergonomically positioned to be readily and naturally seen and touched in a location customary for viewing and touching in a piano environment.

These and other objects of the invention are achieved by a electronic piano having a graphical user interface including a video display and a touch responsive overlay which form part of a music stand for the piano. The graphical user interface can be used to control a computer system within the piano housing that is configured to provide any of a variety of functions, both known and yet to be developed.

The integration of the graphical user interface in the music stand positions the touch control for such control functions as instrument sound selection and volume at the same location that a musician is accustomed to reaching to turn pages of sheet music. Thus, the hand motions are natural and readily made particularly during performances. Similarly, the video display projects images to the user at a level he is accustomed to viewing sheet music in conventional piano playing.

The graphical user interface can be incorporated into a number of different piano housings and does not distract from the aesthetic appearance of the piano housing with separate electronic-type housings, that are out of place in a piano environment.

Accordingly, the electronic piano of the invention provides touch screen control in an ergonomically and aesthetically optimal arrangement within a traditional piano housing.

BRIEF DESCRIPTION OF THE DRAWINGS

A more thorough understanding of the invention can be gained from a reading of the following detailed description together with the accompanying drawings, in which.

DETAILED DESCRIPTION OF PREFERRED EMBODIMENTS

The invention relates to an electronic piano having a touch screen controlled computer system for controlling sound characteristics and other functions such as player piano and educational applications interacting between a video display, touch screen and the keyboard. The piano of the invention provides a graphical user interface that blends ergonomically and aesthetically with a traditional piano housing environment.

Figure 1:
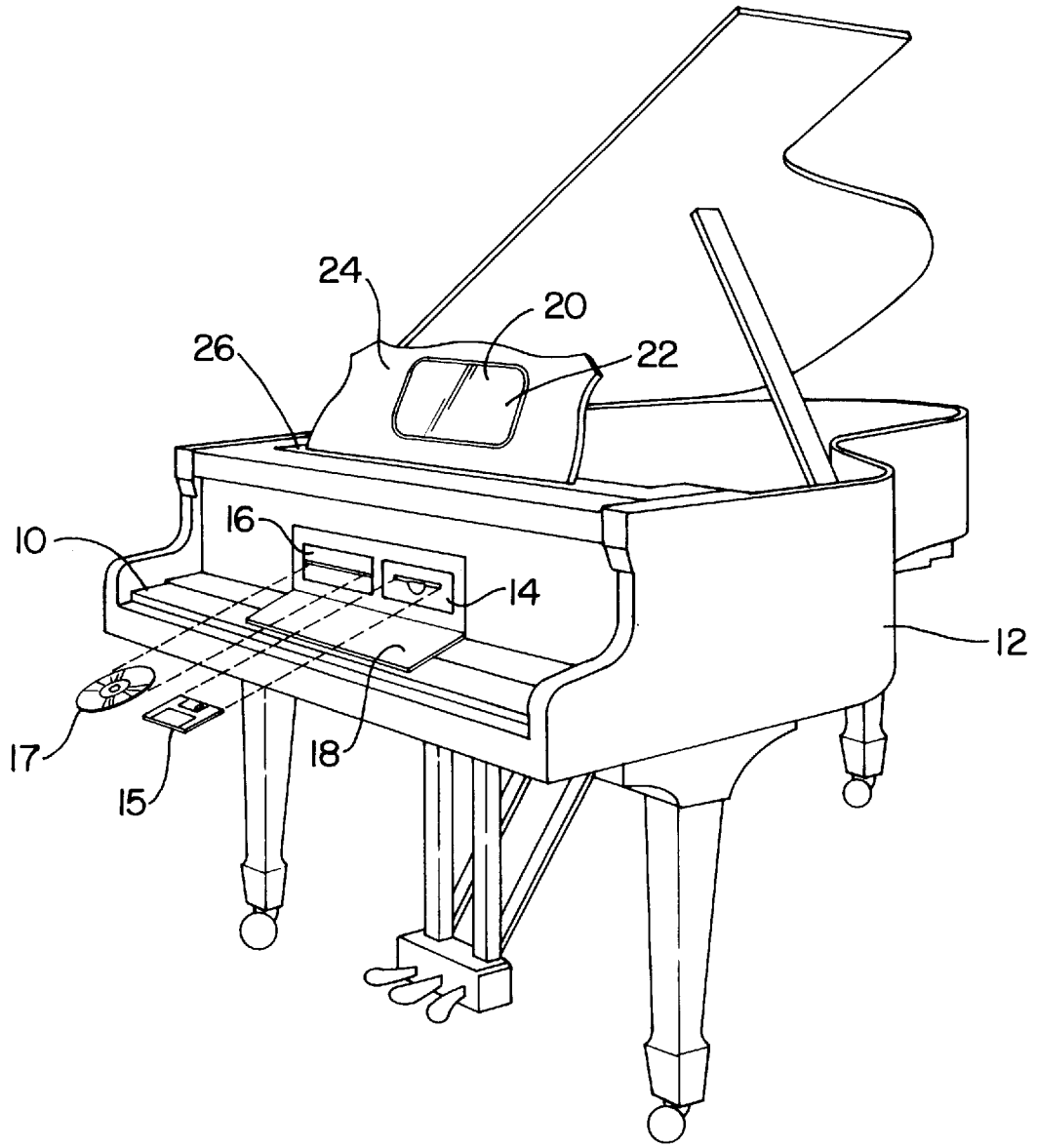
FIG. 1 is a perspective view of a grand piano housing embodiment of the invention.

Referring to FIG. 1, an embodiment of the invention can generally include a musical keyboard 10 encased in a grand piano housing 12. Alternative housings, including upright, console and the like, can be used. The musical keyboard 10 is preferably an 88-key, velocity-sensitive keyboard that is capable of producing electric signals suitable for scanning by a computer system and conversion into MIDI data. The piano preferably includes a computer system, not shown, wihich preferably includes a plurality of digital information sources, such as a drive 14 for floppy disk 15 and a drive 16 for compact discs 17, each being enclosed in the piano housing 12 and optionally hidden behind a cover, such as a hinged door 18.

According to an aspect of the invention, the control of the electronic piano sound parameters and information retrieval and utilization are preferably unified in a graphical user interface presented on a video monitor, such as a flat screen display 20 that is preferably equipped with a touch control overlay 22 for detecting and processing player input through relative position of contact with the overlay 22. The flat screen display 20 is preferably positioned flush in a music stand 24 of the piano housing 12, although other mountings in the stand 24 are possible. The flat screen display 20 is preferably a Sharp Model No. LQ10D031 4-bit color LCD display. The touch control overlay can be provided in a variety of known constructions, such as the use of a 4 or 8 wire analog resistive panel controlled through a microprocessor and analog to digital converter.

The music stand 24 can be formed from a flat board extending upwardly from the upper desk surface 26 of the piano, said board typically angling away from the user to provide an inclined surface for holding sheet music and the like. The sheet materials can rests directly against the desk 26, which may also provide a groove for further security of the sheets, or the stand 24 may provide a supporting lip (not shown) extending from a lower region of the flat board. The board can be made of wood, plastic or other similarly suitable materials and is preferably ornamental along its periphery in keeping with the style of the piano to which it is mounted.

The music stand 24 can be permanently fixed to the piano desk 26, but is preferably mounted such as by hinges to permit angling of the stand 24 and resting the stand 24 flat when not in use. The stand can also be removable, for example, from a slot in the piano desk.

Figure 2:
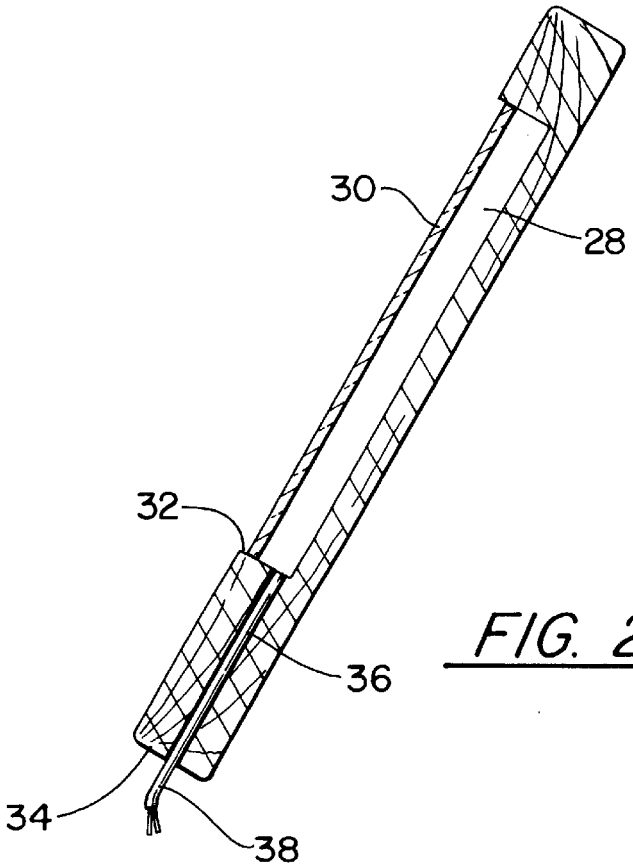
FIG. 2 is a partial sectional view of an alternative music stand construction showing a recessed graphical user interface in the music stand.

Referring to FIG. 2, a flat screen display 28 and a touch input overlay 30 can alternatively be recessed in an opening 32 in a wooden music stand 34. The music stand 34 can provide a passage 36 for cables 38 extending from the display 28 and overlay 30 assembly for remote connection to a computer system and power supply (not shown). The back of the music stand 34 is shown solid and covering the back of the display 28. Alternatives include a continuous opening in which the back of the video display is exposed or covered by a separate cover member or mounting bracket.

Figure 3:
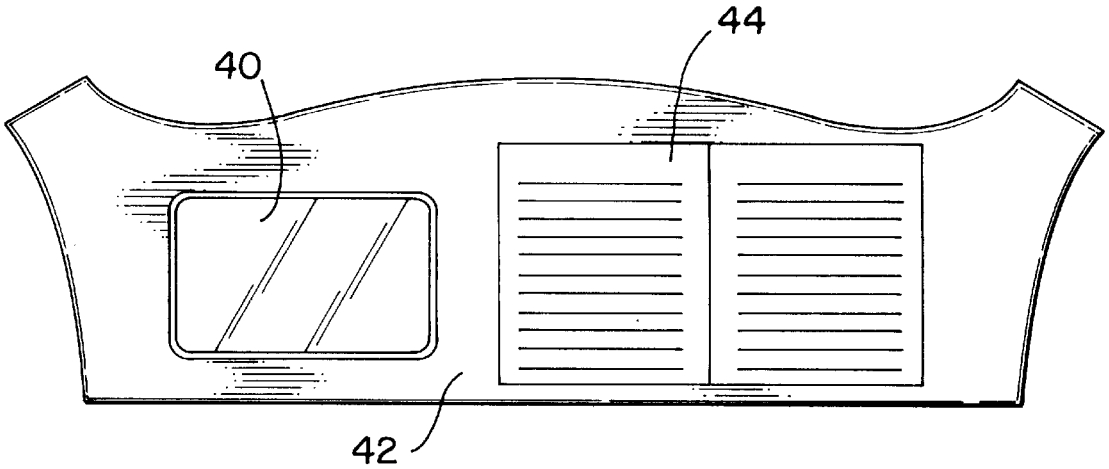
FIG. 3 is a front elevation view of an alternative embodiment in which a user interface is positioned to one side of the music stand.

Referring to FIG. 3, the graphical user interface 40 may be placed in an opening to the side of the music stand 48 so as to maintain the ergonomic and aesthetic advantages of the piano according to the invention while providing simultaneous use and reference to sheet music 44 or other sheet materials on the music stand 42.

Figure 4:
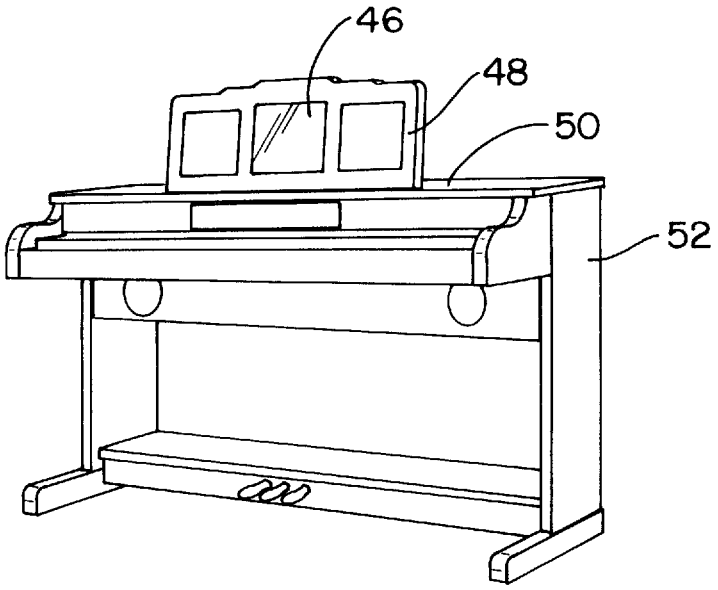
FIG. 4 is an alternative piano housing embodiment.
Figure 5:
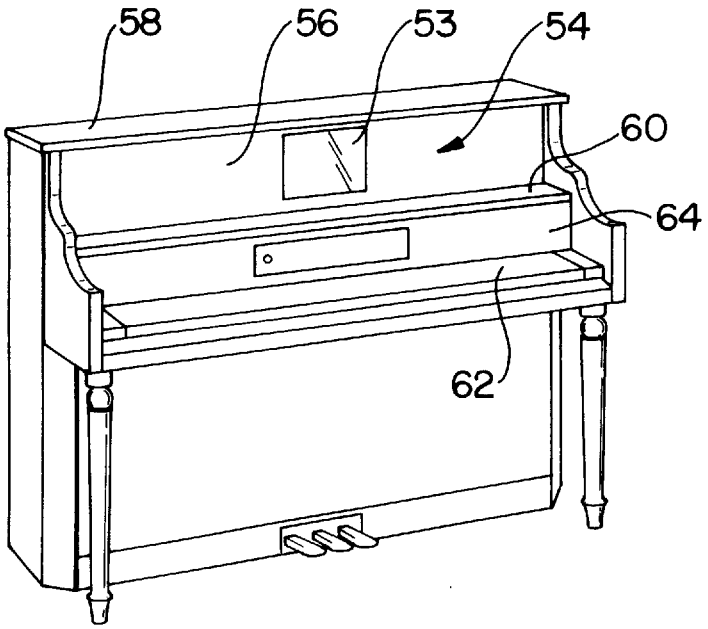
FIG. 5 is a further alternative piano housing embodiment.

Referring to FIG. 4, a graphical user interface 46 can be incorporated into a music stand 48 extending above the highest desk surface 50 of a piano housing 52. Alternatively, as shown in FIG. 5, the graphical user interface 53 and the music stand 54 can be formed by a vertical surface 56 making part of the housing 58 adjacent a supporting ledge 60 upon which sheet material may be placed. The music stand 54 is still spaced above the keyboard 62 and the "falling board" 64.

The graphical user interface can be used to control a variety of computer functions well known in the art and others that may be in development and yet to be developed. The computer system used in the invention can operate to manage a variety of functions for the electronic piano including receiving and processing signals from the keyboard and generating appropriate audio signals to be output by a loudspeaker system. The computer can further provide educational and informational programs output through the loudspeaker system, the video display and actuation of the keys, such as in player piano applications. The computer system can further retrieve digital information, including music information and educational information from the various sources to provide more advanced applications. The functions can be obtained through known computer configurations or through later developed systems yet still remain within the scope of the invention which relates more particularly to the integration of the touch responsive graphical user interface into the electronic piano music stand.

Thus, an ergonomic and aesthetic integration of computer control in a piano environment is provided. Details of various embodiments have been described, intending only to be examples. The scope of the invention should therefore be assessed by the accompanying claims in accordance with the law and not by a foregoing description.

I claim:

1. An electronic piano having a computer based control system, the piano comprising:

a keyboard;

a graphical user interface, having a video display and a touch responsive overlay, for displaying graphical images representing controllable parameters of the electronic piano and generating control signals for the control system;

a piano housing supporting said keyboard and providing a desk surface above the keyboard; and a music stand mounted to said desk surface for supporting sheet material, wherein said graphical user interface forms part of said music stand.

2. The electronic piano of claim 1, wherein the music stand has a front sheet supporting surface providing an opening in which the graphical user interface is mounted.

3. The electronic piano of claim 2, wherein the graphical user interface is recessed from the front sheet supporting surface.

4. The electronic piano of claim 2, wherein the opening is laterally centered in the music stand.

5. The electronic piano of claim 2, wherein the opening is positioned adjacent a lateral edge of the music stand.

6. The electronic piano of claim 1, wherein the housing is a grand piano housing.

7. The electronic piano of claim 1, wherein the housing is a console piano housing.

* * * * *